United States Patent [19]

Bates et al.

[11] Patent Number: 4,576,641

[45] Date of Patent: Mar. 18, 1986

[54] AUSTENITIC ALLOY AND REACTOR COMPONENTS MADE THEREOF

[75] Inventors: John F. Bates, Ogden, Utah; Howard R. Brager, Richland, Wash.; Michael K. Korenko, Wexford, Pa.

[73] Assignee: The United States of America as represented by the United States Department of Energy, Washington, D.C.

[21] Appl. No.: 414,167

[22] Filed: Sep. 2, 1982

[51] Int. Cl.[4] ..... C22C 38/22

[52] U.S. Cl. ..... 75/128 P; 75/128 A; 75/128 T; 75/128 W; 75/128 Z; 148/38; 376/900

[58] Field of Search ..... 75/128 A, 128 Z, 128 T, 75/128 W, 128 P; 148/38, 12 R, 12 B, 12 E, 12.1; 376/900

[56] References Cited

U.S. PATENT DOCUMENTS

| | | | |
|---|---|---|---|
| Re. 27,226 | 11/1971 | Moskowitz et al. | 75/128 P |
| 3,563,729 | 4/1968 | Kovach et al. | 75/128 P |
| 4,158,606 | 6/1979 | Bloom et al. | 75/128 T |
| 4,234,385 | 11/1980 | Ozaki et al. | 75/128 T |
| 4,385,933 | 5/1983 | Ehrlich et al. | 75/124 |
| 4,407,673 | 10/1983 | Korenko | 75/128 A |

OTHER PUBLICATIONS

F. A. Garner et al., Simulation of High Fluence Swelling Behavior in Technological Materials, Radiation Effects in Breeder Reactor Structural Materials, Proceedings of a Conference held Jun. 19-23, 1977, Arizona, published by the Metallurgical Society of the AIME, pp. 543-569 (1977).

W. G. Johnston et al., Summary of Workshop Discussion, Proceedings of the Workshop on Correlation of Neutron and Charged Particle Damage (CONF-760673), held at Oak Ridge National Laboratory, Jun. 8-10, 1976, compiled by J. O. Stiegler, published by NTIS, U.S. Dept. of Commerce, pp. 313-347.

W. K. Appleby, Applications of Simulation Experiments in LMFBR Core Materials Technology. ibid., pp. 291-312.

Garner et al., Review of Neutron and Charged Particle Intercorrelation Programs. ibid., pp. 177-240.

J. F. Bates et al., Effects of Alloy Composition on Void Swelling, Radiation Effects in Breeder Reactor Structural Materials, Proceedings of a Conference held Jun. 19-23, 1977, Arizona, published by the Metallurgical Society of the AIME, pp. 625-644 (1977).

L. E. Thomas, Phase Instabilities and Swelling Behavior in Fuel Cladding Alloys, present at the American Nuclear Society Annual Meeting, San Diego, California, Jun. 18-23, 1978, and published in ANS Transactions, 28 (1978) p. 151.

Shimada et al., Swelling of Type 304 Stainless Steel Bombarded with 200 KeV C+ Ions, Journal of Nuclear Science and Technology, 13(12) pp. 743-751 (Dec. 1976).

Bennett et al., Materials Requirements for Liquid Metal Fast Breeder Reactors, Metallurgical Transactions A, vol. 9A, Feb. 1978, pp. 143-149.

J. F. Bates, Irradiation Induced Swelling Variations Resulting from Compositioned Modification of 316 Stainless Steel, Properties of Reactor Structural Alloys After Neutron or Particle Irradiation, ASTM STP 570, American Society for Testing and Materials, 1975, pp. 369-387.

(List continued on next page.)

*Primary Examiner*—L. Dewayne Rutledge
*Assistant Examiner*—Debbie Yee
*Attorney, Agent, or Firm*—John J. Prizzi

[57] ABSTRACT

An austenitic stainless steel alloy is disclosed, having excellent fast neutron irradiation swelling resistance and good post irradiation ductility, making it especially useful for liquid metal fast breeder reactor applications. The alloy contains: about 0.04 to 0.09 wt. % carbon; about 1.5 to 2.5 wt. % manganese; about 0.5 to 1.6 wt. % silicon; about 0.030 to 0.08 wt. % phosphorus; about 13.3 to 16.5 wt. % chromium; about 13.7 to 16.0 wt. % nickel; about 1.0 to 3.0 wt. % molybdenum; and about 0.10 to 0.35 wt. % titanium.

27 Claims, 2 Drawing Figures

OTHER PUBLICATIO

Y. Kondo et al., The Effects of Metallurgical Variables on Creep of Type 316 Stainless Steels, Radiation Effects in Breeder Reactor Structural Materials, Proceedings of a Conference held Jun. 19–23, 1977, Arizona, published by the Metallurgical Society of the AIME, 1977, pp. 253–267.

K. Vematsu et al., Swelling Behavior of Cold Worked Type 316 Stainless Steel.
ibid., pp. 571–589.

M. Terasawa et al., The Influence of Metallurgical Variables on Void Swelling in Type 316 Steel.
ibid., pp. 687–707.

J. F. Bates et al., Reduction of Irradiation Induced Creep and Swelling in AISI 316 by Compositional Modifications, Effects of Radiation on Materials: Tenth Conference, ASTM STP 725, Kramer, Brager and Perrin, Eds., American Society for Testing and Materials, 1981, pp. 713–734.

F. A. Garner, The Microchemical Evolution of Irradiated Stainless Steels, Phase Stability During Irradiation, ed. by Holland, Mansur and Potter, Conference Proceedings of the Metallurgical Society of the AIME, Pittsburgh, PA, Oct. 5–9, 1980, pp. 165–189, published 1981.

E. H. Lee et al., The Structure and Composition of Phases Occurring in Aus enitic Stainless Steels in Thermal and Irradiation Environments.
ibid., pp. 191–218.

L. K. Mansur et al., Mechanisms Affecting Swelling in Alloys with Precipitates.
ibid., pp. 359–382.

J. F. Bates et al., Effects of Alloy Composition on Void Swelling, op it, Kondo et al., pp. 625–644.

Bates, J. F., "Irradiation–Induced Swelling Variations Resulting from Compositional Modification of Type 316 Steel", 7th International Symposium on Radiation Effects on Structural Materials, Gatlinburg, Tenn., Jun. 11–13, 1974, p. 380.

AUSTENITIC ALLOY AND REACTOR COMPONENTS MADE THEREOF

GOVERNMENT CONTRACT

The invention described herein was made during the course of or in the performance of work under U.S. Government Contract No. EY-76-C-14-2170 under the auspices of the Department of Energy.

BACKGROUND OF THE INVENTION

The present invention relates to austenitic nickel-chromium-iron base alloys having properties making them especially well suited for use in high temperature, high energy neutron irradiation environments, such as found in a liquid metal fast breeder reactor (LMFBR). More particularly the present invention relates to improved titanium modified austenitic stainless steel alloys for use in nuclear applications.

One of the prime objectives in the efforts to develop a commercially viable LMFBR has been to develop an alloy, or alloys, which are swelling resistant and have the required post irradiation mechanical properties for use as fuel cladding and/or use as ducts. The fuel cladding will see service in contact with flowing liquid sodium and have a surface temperature of about 400° C. (~750° F.) to 650° C. (~1200° F.). A duct surrounds each bundle of fuel pins and sees service at about 380° C. (~715° F.) to 550° C. (~1020° F.). These components will be exposed at the aforementioned elevated temperatures to fast neutron fluxes on the order of $10^{15}$ n/cm$^2$.s (E>0.1 MeV), and should be capable of performing adequately to fluences on the order of 2 to $3\times10^{23}$ n/cm$^2$ (E>0.1 MeV).

Initially one of the prime candidate alloys for the LMFBR, especially for fuel cladding and ducts, was 20% cold worked AISI 316 steel, a solid solution austenitic steel (see Bennett and Horton, "Materials Requirements for Liquid Metal Fast Breeder Reactors," *Metallurgical Transactions A,* (Vol. 9A, February 1978, pp. 143–149)). The chemistry specification, and material fabrication steps for nuclear grade 316 fuel cladding are described in U.S. Pat. No. 4,421,572 filed on Mar. 18, 1982.

However, the 316 alloy undergoes a high degree of void swelling during extended exposure to fast neutron fluxes at the LMFBR operating temperatures. Extensive development efforts aimed at reducing the swelling by either modifications to alloy chemistry or fabrication methods have been undertaken. For example, U.S. Pat. No. 4,158,606 pertains to one of these efforts wherein it was concluded that a combination of silicon and titanium additions to solid solution austenitic alloys such as 316 stainless should provide improvements in swelling resistance. This patent also states that minor additions of zirconium also appear to aid in reducing void swelling.

U.S. Pat. No. 4,407,673 issued on Oct. 4, 1983, and based on an application filed on Jan. 9, 1980, describes an effort to provide enhanced swelling resistance by alloy chemistry modifications, including reducing the chromium and molybdenum contents, while increasing the nickel, silicon, titanium and zirconium contents of the 316 alloy.

In the aforementioned materials phosphorus was considered to be an impurity, and the phosphorus contents of the alloys were maintained below 0.02 weight percent.

In spite of the aforementioned extensive efforts swelling due to void formation, and related to phase instabilities, brought about by prolonged exposure to high fluences of fast neutrons at elevated temperatures, remain as areas where significant improvements are needed. The present inventors believe that they have found a new class of austenitic alloys possessing a combination of excellent swelling resistance as well as good post irradiation mechanical properties.

SUMMARY OF THE INVENTION

The present invention provides for a class of alloys having the following composition range in weight percent:

about 0.04 to 0.09 carbon;
about 1.5 to 2.5 manganese;
about 0.5 to 1.6 silicon;
about 0.035 to 0.08 phosphorus;
about 13.3 to 16.5 chromium;
about 13.7 to 16 nickel;
about 1.0 to 3.0 molybdenum;
about 0.10 to 0.35 titanium;
up to 0.20 zirconium;
and the balance being essentially iron.

Within the range outlined above, the phosphorus and/or carbon contents should be balanced against the zirconium content of the alloy to provide optimum swelling resistance.

For zirconium contents from 0.02 wt.% to 0.20 wt.% the carbon and phosphorus contents are selected from the group comprising: about 0.05 to 0.08 wt.% phosphorus and 0.04 to 0.09 wt.% carbon; about 0.035 to 0.08 wt.% phosphorus and about 0.07 to 0.09 wt.% carbon; and about 0.05 to 0.08 wt.% phosphorus and about 0.07 to 0.09 wt.% carbon.

Preferably the zirconium content of alloys according to the present invention is limited to less than about 0.01 wt.%, and most preferably less than about 0.005 wt.% or 0.001 wt.%. In these low zirconium alloys according to the present invention the phosphorus content may be held between about 0.030–0.035 to 0.050 wt.% to provide an optimum combination of fabricability, swelling resistance and post irradiation mechanical properties.

In the various alloys already outlined according to the present invention the silicon content and/or molybdenum contents of the alloys may also be preferably limited to about 0.5 to 1.0 wt.% and about 1.5 to 2.5 wt.%, respectively, to provide improved resistance to swelling due to phase changes at particular reactor operating temperatures. Alloys having molybdenum contents of about 1.0 to 1.7 wt.% are also contemplated for these reasons.

In preferred embodiments of the present invention an alloy in accordance with the chemistry outlined above and having a zirconium content of less than 0.01 wt.% is selected and fabricated into fuel element cladding or ducts having a cold worked microstructure.

Preferably the titanium content is held to about 0.10 to 0.25 wt.%.

Preferably the manganese content is held to about 1.8 to 2.2 wt.%.

It is believed that boron additions may be made to the alloys according to the present invention to provide improved stress rupture properties. Boron contents of about 0.001 to 0.008 wt.% are contemplated, with about 0.003 to 0.006 wt.% being preferred.

These and other aspects of the present invention will become more apparent upon a reading of the following detailed specification in conjunction with the drawings which are listed immediately below.

DETAILED DESCRIPTION OF THE INVENTION

Figure 1:
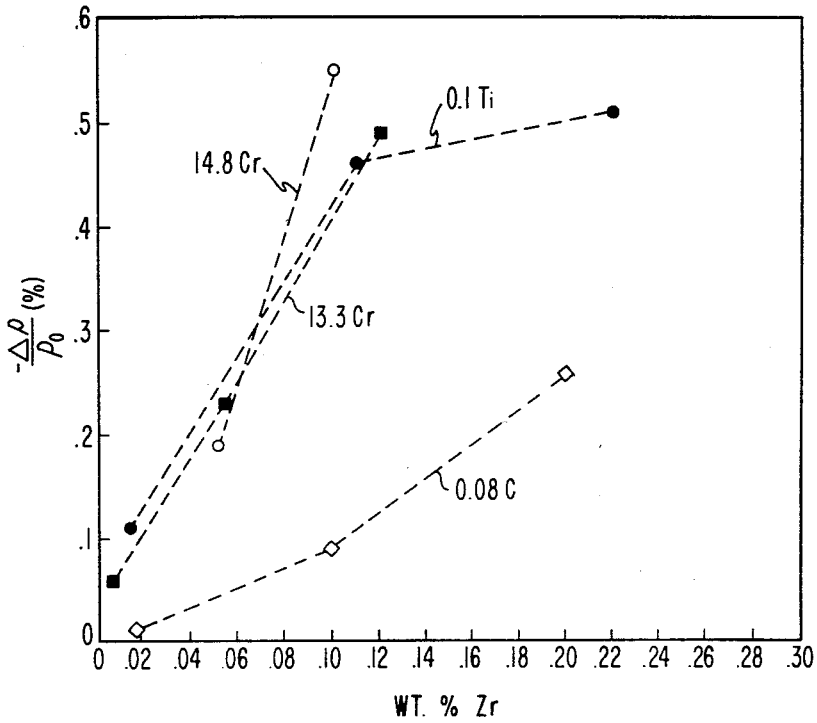
FIG. 1 shows the effects of variations in chromium, titanium, carbon and zirconium content on swelling of a 20% cold worked phosphorus modified alloys.

The general composition range of the alloys according to this invention is as follows: about 0.04 to 0.09 wt.% carbon; about 1.5 to 2.5 wt.% manganese; about 0.5 to 1.6 wt.% silicon; about 0.035 to 0.08 wt.% phosphorus; about 13.3 to 16.5 wt.% chromium; about 13.7 to 16 wt.% nickel; about 1.0 to 3.0 wt.% molybdenum; about 0.10 to 0.35 wt.% titanium; up to 0.20 wt.% zirconium; and the balance being essentially iron. Applicants believe that within this composition range, in order to assure that the optimum swelling resistance is obtained during fast neutron irradiation, that the carbon and/or phosphorus content selected for a particular alloy composition is related to the zirconium content of the alloy. It is believed that for zirconium contents from 0.02 to 0.20 weight percent the carbon and phosphorus contents should be selected from the following ranges:

1. about 0.05 to 0.08 wt.% phosphorous and 0.04 to 0.09 wt.% carbon or
2. about 0.035 to 0.08 wt.% phosphorus and 0.07 to 0.09 wt.% carbon or
3. about 0.05 to 0.08 wt.% phosphorus and 0.07 to 0.09 wt.% carbon.

Within the range of 0.02 to 0.20 wt.% zirconium it is preferred that the carbon and/or phosphorus content be increased as the zirconium content increases. For example, for a zirconium content of about 0.1 wt.% phosphorus and carbon contents of about 0.04 and about 0.08, respectively (see FIG. 1), or about 0.08 and about 0.04, respectively (see FIG. 2), would be appropriate for optimum swelling resistance. For example, for a zirconium content of about 0.20 wt.%, phosphorus and carbon contents of about 0.08 and about 0.08 would be appropriate. For zirconium contents below about 0.02 wt.% the phosphorus and carbon contents may be about 0.035 to 0.08 and about 0.04 to 0.09, respectively.

The upper limit on the phosphorus content is set at about 0.08 wt.% based on ductility testing of irradiated alloys similar to the present invention which have indicated that at phosphorus contents of about 0.04 and 0.08 wt.% the present alloys should have good levels of post irradiation ductility. At about 0.08 wt.% phosphorus, while still exhibiting ductile behavior, the post irradiation ductility of the alloy tested decreased compared to the 0.04 wt.% alloy. The lower limits on the phosphorus content are set at levels that are believed to provide adequate levels of resistance to void swelling in the alloys of the present invention.

It is preferred that the phosphorus, as well as the carbon content, be held below about 0.05 to 0.06 wt.% to provide better weldability in product comprised of the present alloys. Therefore, consistent with this objective, as well as the objective of providing a highly swelling resistant alloy, it is preferred that zirconium content be held below about 0.01 wt.%, and most preferable below about 0.005 or 0.001 wt.%. In these low zirconium content alloys the phosphorus content may be as low as 0.035 and, it is believed, as low as about 0.030 wt.% for zirconium contents below 0.005 wt.% or 0.001 wt.%.

Figure 2:
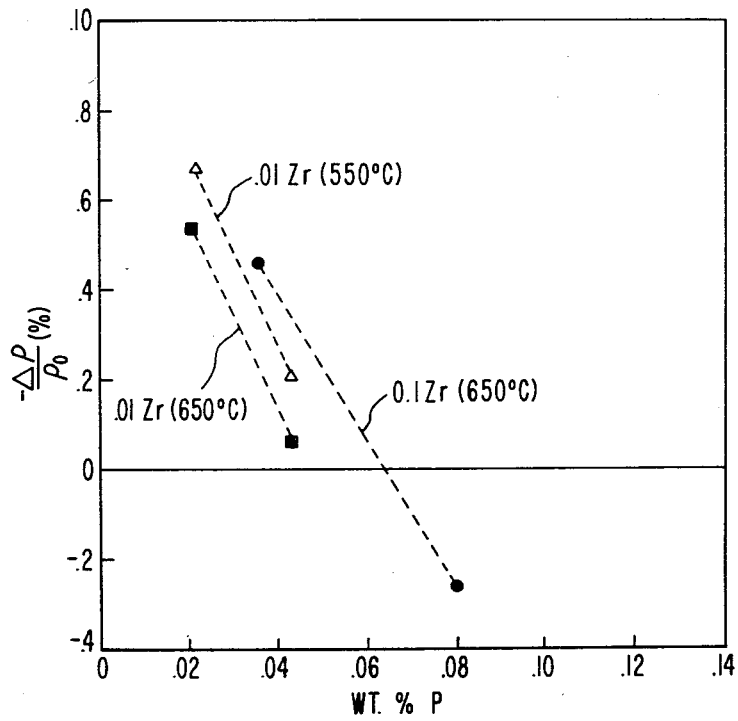
FIG. 2 shows the effects of zirconium and phosphorus variations on the swelling of 20% cold worked titanium modified alloys.

FIG. 2 shows that in 20% cold worked experimental alloys studied by the inventors, having a nominal composition of about 13.8 wt.% Ni—2 wt.% Mn—0.04 wt.% C—0.8 wt.% Si—16.2 wt.% Cr—2.5 wt.% Mo—0.2 wt.% Ti with a nominal zirconium content of 0.01 wt.% both the phosphorus and carbon contents can be held at about 0.04 wt.% and still provide a substantial improvement at 550° C. and 650° C., and fluences of $10.5\times10^{22}$ n/cm$^2$ (E>0.1 MeV) and $11.4\times10^{22}$ n/cm$^2$ (E>0.1 MeV), respectively, over alloys having the same nominal composition, but with about half the phosphorus. FIG. 2 also indicates that if the same nominal composition alloy has its zirconium content increased to about 0.1 wt.%, that significantly greater levels of phosphorus are required to achieve the same swelling resistance at the same temperature (650° C.) and fluence.

FIG. 1 shows how various alloying modifications interact with zirconium content to affect swelling at 550° C. and a fluence of $10.5\times10^{22}$ n/cm$^2$ (E>0.1 MeV) in 20% cold worked alloys having a base nominal composition of about 13.8 wt.% Ni—2 wt.% Mn—0.8 wt.% Si—0.04 wt.% P—2.5 wt.% Mo—0.2 wt.% Ti—0.04 wt.% C—16.3 wt.% Cr. It can be seen that an increase in carbon content of the base nominal composition to 0.08 wt.% inhibits the degradation in swelling resistance caused by increasing the zirconium content. The swelling resistance of alloys having the base nominal composition (except that the chromium content has been decreased to 14.8 or 13.3 wt.%, or the titanium content has been decreased to 0.1 wt.%) is very sensitive to the zirconium content as shown in FIG. 1. It also can be seen in this figure that the best swelling resistance occurs in those alloys having less than 0.02 wt.% zirconium.

It is also believed that the titanium content of these alloys should be preferably held between about 0.10 to 0.25 wt.%, and more preferably about 0.15 to 0.25 wt.% to produce the best swelling resistance.

The silicon content of the present invention should be about 0.5 to 1.5 wt.%. It is believed that while increasing silicon within this range acts to help decrease void swelling, it has been noted for alloys according to the present invention irradiated above about 600° C. there has been an overall increase in swelling at the fluences tested to, which is believed due to increased precipitation of a silicon rich, relatively low density laves phase. It is therefore preferred that the silicon content, especially for alloys to be used for fuel cladding, be held to about 0.5 to 1.0 wt.%, and most preferably about 0.8 to 1.0 wt.%. At lower irradiation temperatures, such as those encountered by ducts, the silicon content may be preferably selected at the higher end of its broad range since laves phase precipitation is not significant at these lower temperatures.

Molybdenum produces an effect on swelling behavior similar to that observed with respect to silicon content, but less pronounced in the alloys of the present invention. Molybdenum also serves as a solid solution strengthening agent in these alloys. It was initially thought that at least 2 wt.% molybdenum was necessary to limit the amount of material in the cold worked alloys that recrystallizes under prolonged irradiation above about 600° C. It was thought that the formation of an MC type carbide phase enriched in molybdenum would act to pin dislocations and thereby tend to suppress recrystallization. Recrystallization in the irradiated fuel cladding has been viewed generally as being undesirable due to concerns that recrystallized material would swell at the same higher rate as solution annealed material and would also adversely affect the mechanical properties of the cladding. It has been found, however, that in an alloy according to the present invention containing only about 1.5 wt.% molybdenum and about 0.04 wt.% phosphorus (Alloy A57), that after irradiation at 650° C. to a peak fluence of $11.4\times10^{22}$ n/cm$^2$ (E>0.1 MeV) that no signs of recrystallization were observed. An iron phosphide type phase was observed, while MC was not observed. It is therefore believed that alloys according to the present invention can have molybdenum contents of about 1 to 1.7 wt.% to reduce the amount of laves phase produced at high irradiation temperatures. It is, however, preferred that for fuel element applications that the molybdenum content be held within the range of 1.5 to 2.5 wt.% to provide solid solution strengthening, while silicon is held to 0.5 to 1.0, or 0.8 to 1.0 wt.%, as previously described.

The stainless steel alloys according to the present invention may be melted, cast and hot worked by means well known to those skilled in the art. After hot working to an intermediate size the alloys are then reduced to final size by a series of cold working steps interspersed with process anneals prior to each cold working step. The cold working steps may take the form of rolling reductions to produce sheet for duct applications, or, for cladding applications, may take the form of any of the tube or rod forming methods known in the art. The process anneals are preferably performed at about 1000° C. to 1300° C. (more preferably 1000°-1200° C.) for about 2 to 15 minutes followed by air cooling. Intermediate process anneals of 2-5 minutes at 1050° C. or about 15 minutes at 1150° F. with cold reduction of about 40-50% has been found to be acceptable fabrication methods. The final two thermomechanical working steps which bring the material to substantially final size are a final annealing step followed by a cold working step, preferably providing a reduction of about 10 to 40% in cross sectional area. While a solution anneal at 1150° C. for 15 minutes followed by air cooling and then a cold rolling reduction of 20% was typically utilized in the following examples, final anneals at temperatures up to 1300° C. have also been found to produce acceptable results when followed by cold working.

The following examples are provided to further illustrate the present invention.

Reduced size experimental ingots were cast hot worked to an intermediate size, solution annealed, and then cold rolled in steps with intermediate solution anneals as previously described. A final anneal was performed at 1150° C. for 15 minutes followed by air cooling. Subsequently, the material received a final cold rolling reduction of 20% to provide a final thickness sheet of about 0.5 mm (0.02 inches). Heat chemistries of some materials tested are shown in Table I. Heats A1, A2, A3, A16, A41, A57, A59 and A97 provide examples of alloys within the present invention. Heat A37, an alloy containing 0.021 wt.% phosphorus, which is outside of the present invention, is included for comparison purposes.

TABLE I

| | Alloy Compositions | | | | | | | | |
|---|---|---|---|---|---|---|---|---|---|
| | A1 | A2 | A3 | A16 | A37 | A41 | A57 | A97 | A59 |
| C | 0.047 | 0.083 | 0.040 | 0.082 | 0.039 | 0.040 | 0.039 | 0.037 | 0.042 |
| Mn | 1.97 | 2.02 | 2.02 | 2.00 | 1.98 | 2.00 | 2.00 | 1.98 | 2.02 |
| Si | 0.77 | 0.79 | 0.80 | 0.76 | 0.77 | 0.96 | 0.73 | 0.73 | 1.47 |
| P | 0.043 | 0.036 | 0.080 | 0.037 | 0.021 | 0.044 | 0.044 | 0.042 | 0.044 |
| S | 0.014 | 0.017 | 0.017 | 0.016 | 0.018 | 0.015 | 0.016 | 0.004 | 0.016 |
| Cr | 16.30 | 16.25 | 16.15 | 16.22 | 16.20 | 16.33 | 16.23 | 16.30 | 16.33 |
| Ni | 13.98 | 13.69 | 13.75 | 13.59 | 13.73 | 13.83 | 13.83 | 13.71 | 13.80 |
| Mo | 2.46 | 2.46 | 2.48 | 2.51 | 2.46 | 2.45 | 1.52 | 2.48 | 1.52 |
| Cu | 0.04 | 0.05 | 0.06 | 0.05 | 0.05 | 0.04 | 0.04 | <0.01 | 0.05 |
| B | <0.0005 | <0.0005 | <0.0005 | <0.0005 | <0.0005 | <0.0005 | <0.0005 | <0.0005 | <0.0005 |
| Co | 0.05 | 0.06 | 0.06 | 0.06 | 0.06 | 0.06 | 0.05 | 0.01 | 0.06 |
| Ti | 0.19 | 0.23 | 0.18 | 0.20 | 0.21 | 0.18 | 0.18 | 0.19 | 0.20 |
| Al | 0.015 | 0.027 | 0.034 | 0.038 | 0.032 | 0.030 | 0.023 | <0.01 | 0.028 |
| V | 0.025 | 0.017 | 0.024 | 0.018 | 0.014 | 0.013 | 0.013 | 0.010 | 0.016 |
| Nb | 0.011 | 0.011 | 0.011 | 0.015 | 0.013 | 0.012 | 0.010 | <0.005 | 0.011 |
| Ta | 0.013 | 0.015 | 0.014 | 0.013 | 0.020 | 0.011 | 0.010 | <0.01 | 0.010 |
| As | 0.011 | 0.013 | 0.013 | 0.011 | 0.013 | 0.011 | 0.011 | <0.001 | 0.012 |
| N | 0.019 | 0.017 | 0.019 | 0.019 | 0.015 | 0.011 | 0.017 | 0.004 | 0.017 |
| O | 0.0024 | 0.0026 | 0.0019 | 0.0027 | 0.0022 | 0.0029 | 0.0029 | 0.0022 | 0.0021 |
| Sn | 0.020 | 0.022 | 0.022 | 0.020 | 0.020 | 0.020 | 0.020 | <0.001 | 0.019 |
| Zr | 0.005 | 0.017 | 0.11 | 0.10 | 0.018 | 0.017 | 0.017 | <0.001 | 0.017 |
| W | 0.02 | 0.01 | 0.01 | 0.01 | 0.01 | 0.01 | <0.01 | 0.01 | 0.01 |
| Sb | <0.001 | | | | | <0.001 | <0.001 | <0.001 | |
| Ba | <0.002 | | | | | <0.002 | <0.002 | <0.002 | |
| Ca | <0.001 | | | | | <0.001 | <0.001 | <0.001 | |
| Zn | <0.001 | | | | | <0.001 | <0.001 | <0.001 | |
| Bi | <0.0001 | | | | | <0.0001 | <0.0001 | <0.0001 | |
| Pb | <0.0005 | | | | | <0.0005 | <0.0005 | <0.0005 | |
| Hf | | <0.01 | | | | | | | |
| Balance essentially Fe | | | | | | | | | |

TABLE II

| Percent Swelling of 20% Cold Worked Alloys | | | | | |
|---|---|---|---|---|---|
| | Swelling, % $-\frac{\Delta\rho}{\rho o}$ | | | | |
| Temperature, °C. | 450 | 500 | 550 | 600 | 650 |
| Fluence × $10^{22}$ n/cm$^2$ (E>0.1 MeV) | 7.6 | 6.7 | 10.5 | 10 | 11.4 |
| Alloy | | | | | |
| A1 | −0.06 | | +0.21 | −0.17 | +0.06 |
| A2 | −0.08 | −0.21 | +0.01 | −0.03 | |
| A3 | −0.10 | −0.28 | −0.24 | +0.02 | −0.26 |

TABLE II-continued

Percent Swelling of 20% Cold Worked Alloys

| Temperature, °C. | 450 | 500 | 550 | 600 | 650 |
|---|---|---|---|---|---|
| Fluence × $10^{22}$ n/cm$^2$ (E>0.1 MeV) | 7.6 | 6.7 | 10.5 | 10 | 11.4 |
| | Swelling, % $-\frac{\Delta\rho}{\rho o}$ | | | | |
| A16 | −0.26 | −0.52 | +0.09 | 0.00 | −0.10 |
| A37 | −0.17 | | +0.67 | +0.10 | +0.54* |
| A41 | −0.07 | | −0.10* | −0.12 | −0.01 |
| A57 | +0.16 | | +0.27 | −0.18 | +0.05 |
| A59 | +0.04 | −0.29 | +0.29 | +0.07 | +0.31 |
| A97 | −0.12 | | −0.08 | −0.13 | |

*Scatter of density measurements slightly greater than acceptance criteria of ± 0.16% from the average of all density measurements for that specimen.

Irradiation test samples of these materials were then irradiated in EBR-II fast reactor at Idaho Falls, Idaho at temperatures ranging from 450° to 650° C. Selected test samples were removed at predetermined intervals for density measurements, and, in some cases microstructural evaluation. The swelling of each of these samples was determined by taking the negative of the change in density after irradiation and dividing it by the preirradiation density. Swelling results, as determined for the heats shown in Table I after exposure to various fast neutron (E>0.1 MeV) fluences at various temperatures are shown in Table II. A positive value indicates swelling, while a negative value indicates densification. The results shown typically represent an average of at least three density measurements. It can be seen that at 550° C. and at 650° C., for the fluences tested to, that the low phosphorus alloy, A37, undergoes greater bulk swelling than the alloys according to the present invention.

At these swelling levels, however, it could not be concluded from density measurements alone whether the swelling observed is a direct result of void formation, phase changes, or a combination of the two. TEM (Transmission Electron Microscopy) in conjunction with EDX (Energy Dispersive X-ray Analysis) examinations were performed on selected specimens to provide additional information.

First, TEM and EDX examinations of unirradiated microstructures of alloys A1, A3 and A57 showed little difference among them. A 15 minute 1150° C. annealing treatment left only a few blocky TiC and $Zr_4C_2S_2$ particles at grain boundaries. The subsequent 20% cold work treatment induced a dislocation density of about $1.5\times10^{11}$/cm$^2$ in the matrix.

TEM and EDX examinations of irradiated specimens were also performed, and included alloy A1, A3, A37, A41, A57, and A59 specimens irradiated at 450° and 600° C. Insignificant patches of local void swelling were generally observed at 600° C. in the majority of the alloys examined except that no voids were observed in alloys containing greater than 1 wt.% silicon and alloys containing nominally 0.08 wt.% phosphorus. Somewhat uniform void swelling, 0.1%, was observed in alloy A37 (0.021 wt.% P) at 450° C. No void swelling was observed in the alloys according to this invention at 450° C. These results confirm the improved resistance to void swelling found in the alloys of the present invention.

The TEM and EDX evaluations also found that fine, dispersive, needle shape phosphide precipitates formed in the alloys according to this invention during irradiation. At 600° C., the major precipitate phase observed in the matrix was the needle shaped phosphide, while MC was not observed. The amount of phosphide precipitates observed increased with increasing alloy phosphorus content. No phosphides were observed in the A37 alloy, at the reported temperatures and fluences, however MC was observed in this alloy. In the A3 alloy containing about 0.08 wt.% phosphorus, phosphides were also observed at 450° C., in addition to $\delta'$, $\eta$ and $M_{23}C_6$, which were observed in all the alloys examined after irradiation at 450° C. The MC phase was not observed in the alloys of this invention at 450° C. Laves phase was observed in all the alloys examined after irradiation at 600° C. The concentration of laves phase observed was dependent on alloy composition and increased as the Mo and/or Si content of the alloy increased. Eta and $M_{23}C_6$ were also observed at 600° C. G phase was not observed in any of the irradiated cold worked alloys examined.

The phosphide phase that was observed in the irradiated alloys is believed to be of the FeP type having an orthorhombic lattice structure.

The proceeding examples have been provided to illustrate the present invention and are not intended to limit the scope of the invention. It will be apparent to those skilled in the art that variations and modifications in the alloys may be made without departing from the spirit and scope of the invention and it is our intent that the following claims be interpreted to include these embodiments.

We claim:

1. An austenitic nickel-chromium-iron base alloy consisting essentially of:
   about 0.04 to 0.09 wt.% carbon;
   about 1.5 to 2.5 wt.% manganese;
   about 0.5 to 1.6 wt.% silicon;
   about 0.035 to 0.08 wt.% phosphorus;
   about 13.3 to 16.5 wt.% chromium;
   about 13.7 to 16.0 wt.% nickel;
   about 1.0 to 3.0 wt.% molybdenum;
   about 0.10 to 0.35 wt.% titanium;
   up to about 0.20 wt.% zirconium;
   wherein for zirconium contents from 0.02 to 0.20 wt.% the carbon and phosphorus contents are selected from the group consisting of about 0.05 to 0.08 wt.% phosphorus and about 0.04 to 0.09 wt.% carbon, about 0.035 to 0.08 wt.% phosphorus and about 0.07 to 0.09 wt.% carbon, and about 0.05 to 0.08 wt.% phosphorus and about 0.07 to 0.09 wt.% carbon; and the balance of said alloy being essentially iron.

2. The alloy according to claim 1 wherein said zirconium is limited to less than about 0.01 wt.% of said alloy.

3. The alloy according to claim 1 wherein said silicon is limited to about 0.5 to 1.0 wt.% of said alloy.

4. The alloy according to claim 2 wherein said silicon is limited to about 0.5 to 1.0 wt.% of said alloy.

5. The alloy according to claim 4 wherein said phosphorus is limited to about 0.035 to 0.06 wt.% of said alloy.

6. The alloy according to claim 1 or 3 wherein said molybdenum content is limited to about 1.0 to 1.7 wt.% of said alloy.

7. The alloy according to claim 1 or 3 wherein said zirconium content is limited to less than about 0.005 wt.% of said alloy.

8. The alloy according to claim 2 wherein said phosphorus is limited to about 0.035 to 0.06 wt.% of said alloy.

9. The alloy according to claim 7 wherein said phosphorus is limited to about 0.035 to 0.060 wt.% of said alloy.

10. The alloy according to claim 1 wherein said zirconium content is limited to less than about 0.001 wt.%.

11. A fuel element cladding tube for use in an elevated temperature, high fluence fast neutron environment, said tube comprising: an alloy consisting essentially of about 0.04 to 0.08 wt.% carbon,
about 1.5 to 2.5 wt.% manganese,
about 0.5 to 1.0 wt.% silicon,
about 0.030 to 0.08 wt.% phosphorus,
about 13.3 to 16.5 wt.% chromium,
about 13.7 to 16 wt.% nickel,
about 1.0 to 1.7 wt.% molybdenum,
about 0.10 to 0.35 wt.% titanium,
less than 0.005 wt.% zirconium,
and the balance essentially iron;
and a cold worked microstructure.

12. The cladding tube according to claim 11 wherein an iron phosphide type phase is precipitated in said alloy during use.

13. A process for making fuel element cladding for use in a liquid metal fast breeder reactor comprising the steps of:

selecting an alloy consisting essentially of,
about 0.04 to 0.08 wt.% carbon,
about 1.5 to 2.5 wt.% manganese,
about 0.5 to 1.6 wt.% silicon,
about 0.035 to 0.08 wt.% phosphorus,
about 13.3 to 16.5 wt.% chromium,
about 13.7 to 16 wt.% nickel,
about 1.0 to 3.0 wt.% molybdenum,
about 0.10 to 0.35 wt.% titanium,
less than about 0.01 wt.% zirconium,
and the balance being essentially iron;
fabricating said alloy into tubing;
and wherein said fabricating includes cold working reductions having intermediate anneals between each cold working step,
and a final reducing step comprising a cold working reduction of about 15 to 30 percent reduction in area.

14. An austenitic alloy consisting essentially of:

about 0.04 to 0.06 wt.% carbon;
about 1.5 to 2.5 wt.% manganese;
about 0.5 to 1.0 wt.% silicon;
about 0.030 to 0.05 wt.% phosphorus;
about 13.3 to 16.5 wt.% chromium;
about 13.7 to 16 wt.% nickel;
about 1.0 to 3.0 wt.% molybdenum;
about 0.10 to 0.35 wt.% titanium;
less than about 0.01 wt.% zirconium;
and the balance essentially iron.

15. The alloy according to claim 14 wherein said zirconium is limited to less than 0.005 wt.%.

16. The alloy according to claim 14 wherein said zirconium is limited to less than 0.001 wt.%.

17. The alloy according to claim 1, 11 or 14 wherein said titanium content is limited to about 0.10 to 0.25 wt.%.

18. The alloy according to claim 1, 11 or 14 wherein said manganese content is limited to about 1.8 to 2.2 wt.%.

19. The alloy according to claim 1 or 14 wherein said molybdenum content is limited to about 1.5 to 2.5 wt.%.

20. The alloy according to claim 1, 14 or 16 wherein said silicon is limited to about 0.8 to 1.0 wt.%.

21. The alloy according to claim 1 wherein said silicon is limited to about 0.8 to 1.0 wt.% and said molybdenum is limited to about 1.0 to 1.7 wt.%.

22. The fuel element cladding tube according to claim 11 wherein said silicon is limited to about 0.8 to 1.0 wt.%.

23. The process according to claim 13 wherein said alloy selected contains about 1.8 to 2.2 wt.% manganese
about 0.8 to 1.0 wt.% silicon
about 1.5 to 2.5 wt.% molybdenum
and about 0.10 to 0.25 wt.% titanium.

24. The process according to claim 13 wherein the intermediate anneal immediately prior to said final reducing step is a solution anneal performed at about 1000° to 1200° C.

25. The alloy according to claim 21 wherein said titanium is limited to about 0.15 to 0.25 wt.%.

26. The fuel element cladding tube according to claim 23 wherein said titanium is limited to about 0.15 to 0.25 wt.%.

27. The alloy according to claim 1 or 14 wherein said alloy is characterized by: a cold worked microstructure, and excellent resistance to swelling caused by the high fluences of fast neutron irradiation in the temperature range of about 450° to 650° C. encountered in a liquid metal fast breeder reactor.

* * * * *